US011946718B2

(12) United States Patent
Obteshka et al.

(10) Patent No.: US 11,946,718 B2
(45) Date of Patent: Apr. 2, 2024

(54) CROSSBOW WITH SPIRAL WOUND CAM SYSTEM

(71) Applicant: Ravin Crossbows, LLC, Superior, WI (US)

(72) Inventors: Nicholas Obteshka, Springfield, OR (US); Craig Yehle, Winona, MN (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 17/973,258

(22) Filed: Oct. 25, 2022

(65) Prior Publication Data

US 2023/0127133 A1 Apr. 27, 2023

Related U.S. Application Data

(60) Provisional application No. 63/272,030, filed on Oct. 26, 2021.

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC ..... F41B 5/123
See application file for complete search history.

(56) References Cited

U.S. PATENT DOCUMENTS

| | | | | |
|---|---|---|---|---|
| 9,377,267 | B1 * | 6/2016 | Kempf | F41B 5/105 |
| 9,879,938 | B1 * | 1/2018 | Isenhower | F41B 5/123 |
| 10,077,965 | B2 | 9/2018 | Yehle | |
| 10,495,404 | B2 * | 12/2019 | Shaffer | F41B 5/1469 |
| 10,767,956 | B2 * | 9/2020 | Popov | F41B 5/123 |
| 2019/0360774 | A1 * | 11/2019 | Popov | F41B 5/105 |
| 2022/0205755 | A1 * | 6/2022 | Yehle | F41B 5/105 |
| 2022/0307791 | A1 * | 9/2022 | Trpkovski | F41B 5/123 |

* cited by examiner

*Primary Examiner* — John A Ricci
(74) *Attorney, Agent, or Firm* — Foley & Lardner LLP

(57) ABSTRACT

A crossbow including a frame having a projectile axis; a first flexible limb and a second flexible limb attached to the frame; a first cam attached having a larger diameter portion, a smaller diameter portion, and a rotational axis substantially parallel to the projectile axis; a second cam having a larger diameter portion, a smaller diameter portion, and a rotational axis substantially parallel to the projectile axis; a first pulley attached to the first flexible limb; a second pulley attached to the second flexible limb; a first power cable attached to the smaller diameter portion of the first cam and the first flexible limb; a second power cable attached to the smaller diameter portion of the second cam and the second flexible limb; and a drawstring attached to the larger diameter portion of the first cam and the larger diameter portion of the second cam.

38 Claims, 19 Drawing Sheets

CROSSBOW WITH SPIRAL WOUND CAM SYSTEM

CROSS-REFERENCE TO RELATED APPLICATIONS

This application claims priority to and the benefit of U.S. Provisional Patent Application No. 63/272,030, titled CROSSBOW WITH SPIRAL WOUND CAM SYSTEM, filed on Oct. 26, 2021, the entire contents of which are incorporated herein by reference.

BACKGROUND

Crossbows utilize a drawstring that is drawn backward and released to fire a projectile. A common projectile is called a "bolt," which is a type of arrow that is often stiffer and shorter than those used in archery bows. In crossbows, flexible limbs may be loaded with force by the drawstring being drawn, and limbs are unloaded with force when the crossbow is fired that powers the movement of the drawstring toward the front of the crossbow.

The more aggressively the drawstring travels to the front of the crossbow, the faster a bolt can be fired from the crossbow. As such, the higher the force required to load the flexible limbs, the faster the flexible limbs become unloaded when the crossbow is fired. Similarly, the higher the force it takes to load the flexible limbs the higher the force—draw weight—required to draw the drawstring. Drawing aids and let-off cams are often used to aid the shooter in both drawing the drawstring and keeping the power drawstring drawn until it is released when fired.

As such, there is a need for a crossbow that fires a projectile at sufficient speeds, while also maintaining a compact form factor and allowing the shooter to more easily draw the drawstring when arming the crossbow.

SUMMARY

This application generally relates to a crossbow. In particular, this application relates to a crossbow having pulleys and cams to improve performance of the crossbow.

The disclosure is directed to a crossbow that includes a frame having a projectile axis extending between a front and a rear of the crossbow, wherein a projectile moves along the projectile axis during firing of the crossbow; a first flexible limb and a second flexible limb, each first and second limb having a first end attached to the frame and a second end, wherein the first and second flexible limbs are in an unloaded position when the crossbow is undrawn and in a loaded position when the crossbow is drawn; a first cam attached at a first frame side, wherein the first cam has a larger diameter portion and a smaller diameter portion, the first cam further including a rotational axis substantially parallel to the projectile axis; a second cam attached at a second frame side, wherein the second cam has a larger diameter portion and a smaller diameter portion, the second cam further including a rotational axis substantially parallel to the projectile axis; a first pulley attached at the second end of the first flexible limb; a second pulley attached at the second end of the second flexible limb; a first power cable at the first frame side, the first power cable having a first and second end, the first end attached to the smaller diameter portion of the first cam, the second end attached to the second end of the first flexible limb; a second power cable at the second frame side, the second power cable having a first and second end, the first end attached to the smaller diameter portion of the second cam, the second end attached to the second end of the second flexible limb; and a drawstring having a first and second end, wherein the first end is attached to the larger diameter portion of the first cam and the second end is attached to the larger diameter portion of the second cam.

The disclosure is also directed to a crossbow that includes a frame including a projectile axis, wherein a projectile moves along the projectile axis during firing of the crossbow, and wherein the projectile is fired from a front end of the frame; a first flexible limb and a second flexible limb, each first and second flexible limb having a first end attached to the frame and a second end, wherein the first and second flexible limbs are in an unloaded position when the crossbow is undrawn and in a loaded position when the crossbow is drawn; a first cam attached at a first frame side, wherein the first cam has a larger diameter portion and a smaller diameter portion, the first cam further including a rotational axis substantially parallel to the projectile axis; a second cam attached at a second frame side, wherein the second cam has a larger diameter portion and a smaller diameter portion, the second cam further including a rotational axis substantially parallel to the projectile axis; a first power cable at a first frame side, the first power cable having a first and second end, the first end of the first power cable attached to the frame and the second end of the first power cable attached to the smaller diameter portion of the first cam; a second power cable at a second frame side, the second power cable having a first and second end, the first end of the second power cable attached to the frame and the second end of the second power cable attached to the smaller diameter portion of the second cam; and a drawstring having a first and second end, wherein the first end is attached to the larger diameter portion of the first cam and the second end is attached to the larger diameter portion of the second cam. The drawstring wraps at least partially around the larger diameter portions of the cams when the crossbow is undrawn and the first and second power cables wrap at least partially around the smaller diameter portions of the cams when the crossbow is in the loaded position.

The disclosure is also directed to a crossbow that includes a frame having a projectile axis, wherein a projectile moves along the projectile axis during firing of the crossbow; a flexible limb having a first end attached to the frame and a second end, wherein the flexible limb is in an unloaded position when the crossbow is undrawn and in a loaded position when the crossbow is drawn; a cam attached to the frame, the cam having a larger diameter portion and a smaller diameter portion, wherein the larger diameter portion has a larger diameter than the smaller diameter portion; the cam further having a rotational axis substantially parallel to the projectile axis; a power cable having a first and second end, the first end attached to the smaller diameter portion and the second end attached to the second end of the limb; and a drawstring having a first and second end, wherein the ends are attached to the larger diameter portion of the cam. The drawstring wraps around the larger diameter portions of the cam when the crossbow is undrawn and the power cable wraps around the smaller diameter portion of the cam when the crossbow is in the loaded position.

The disclosure is also directed to a draw system for a crossbow having a frame and a projectile axis. The draw system includes a first flexible limb and a second flexible limb, each first and second limb having a first end attached to the frame and a second end, wherein the first and second flexible limbs are in an unloaded position when the crossbow is undrawn and in a loaded position when the crossbow is drawn; a first cam attached at a first frame side, wherein the first cam has a larger diameter portion and a smaller diameter portion, the first cam further including a rotational axis substantially parallel to the projectile axis; a second cam attached at a second frame side, wherein the second cam has a larger diameter portion and a smaller diameter portion, the second cam further including a rotational axis substantially parallel to the projectile axis; a first pulley attached at the second end of the first flexible limb; a second pulley attached at the second end of the second flexible limb; a first power cable at the first frame side, the first power cable having a first and second end, the first end attached to the smaller diameter portion of the first cam, the second end attached to the second end of the first flexible limb; a second power cable at the second frame side, the second power cable having a first and second end, the first end attached to the smaller diameter portion of the second cam, the second end attached to the second end of the second flexible limb; and a drawstring having a first and second end, wherein the first end is attached to the larger diameter portion of the first cam and the second end is attached to the larger diameter portion of the second cam.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
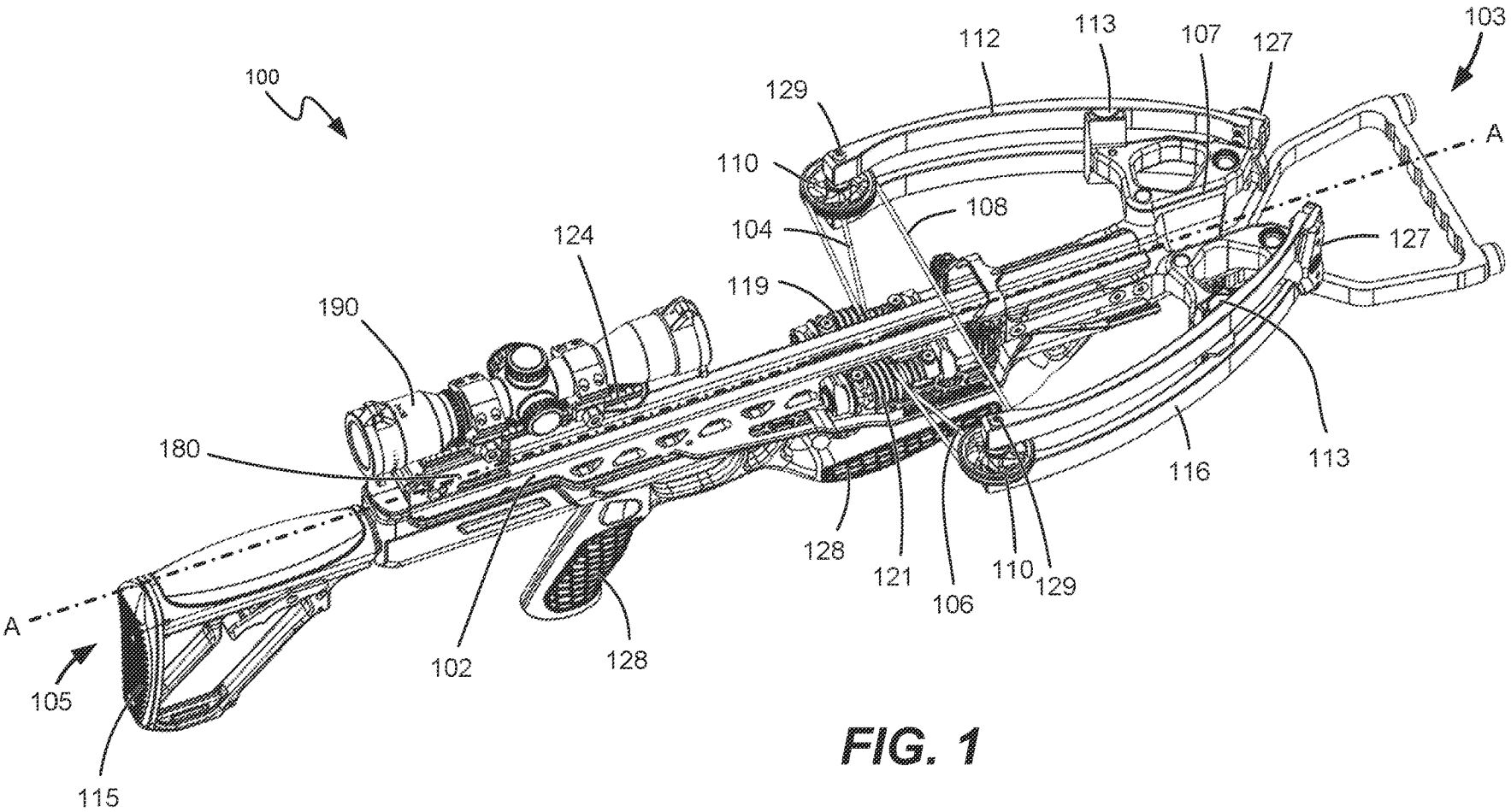
FIG. 1 is a rear perspective view of one embodiment of a crossbow according to the principles of the present disclosure, showing the crossbow in an undrawn position.
Figure 2:
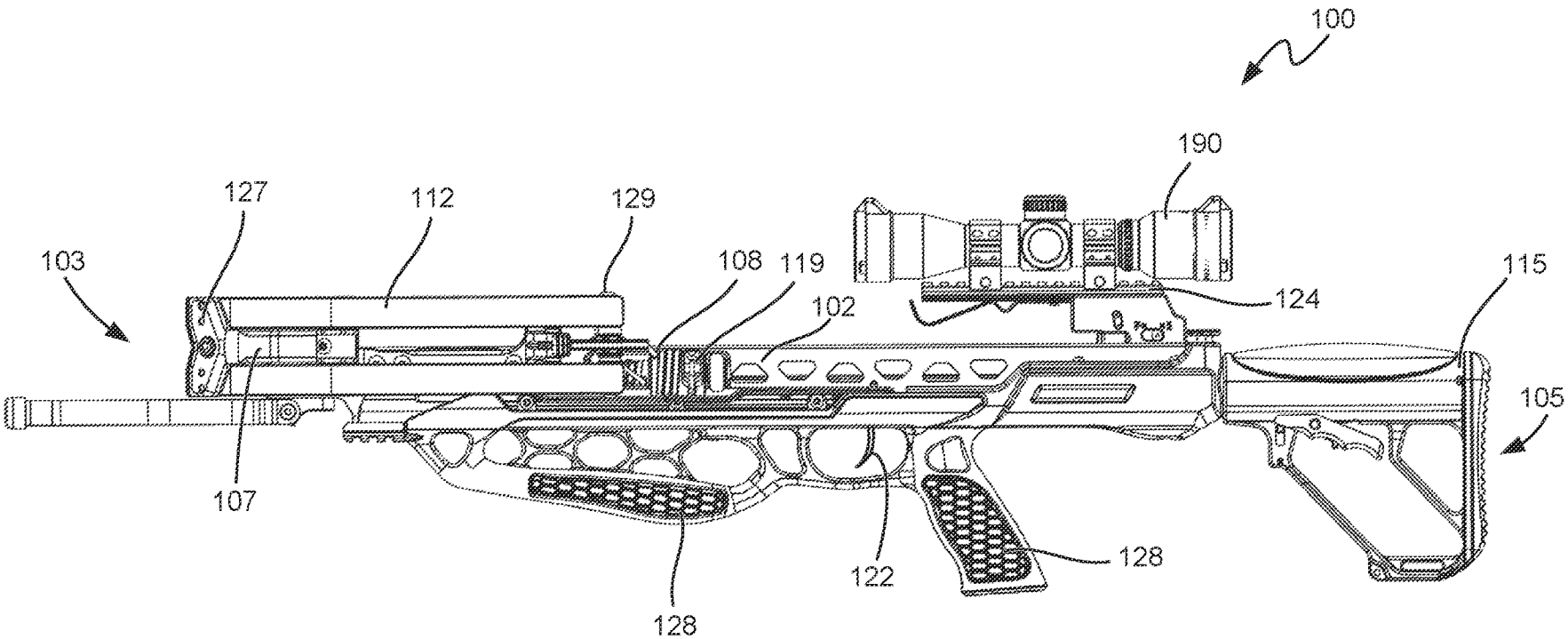
FIG. 2 is a side view of the crossbow of FIG. 1.
Figure 3:
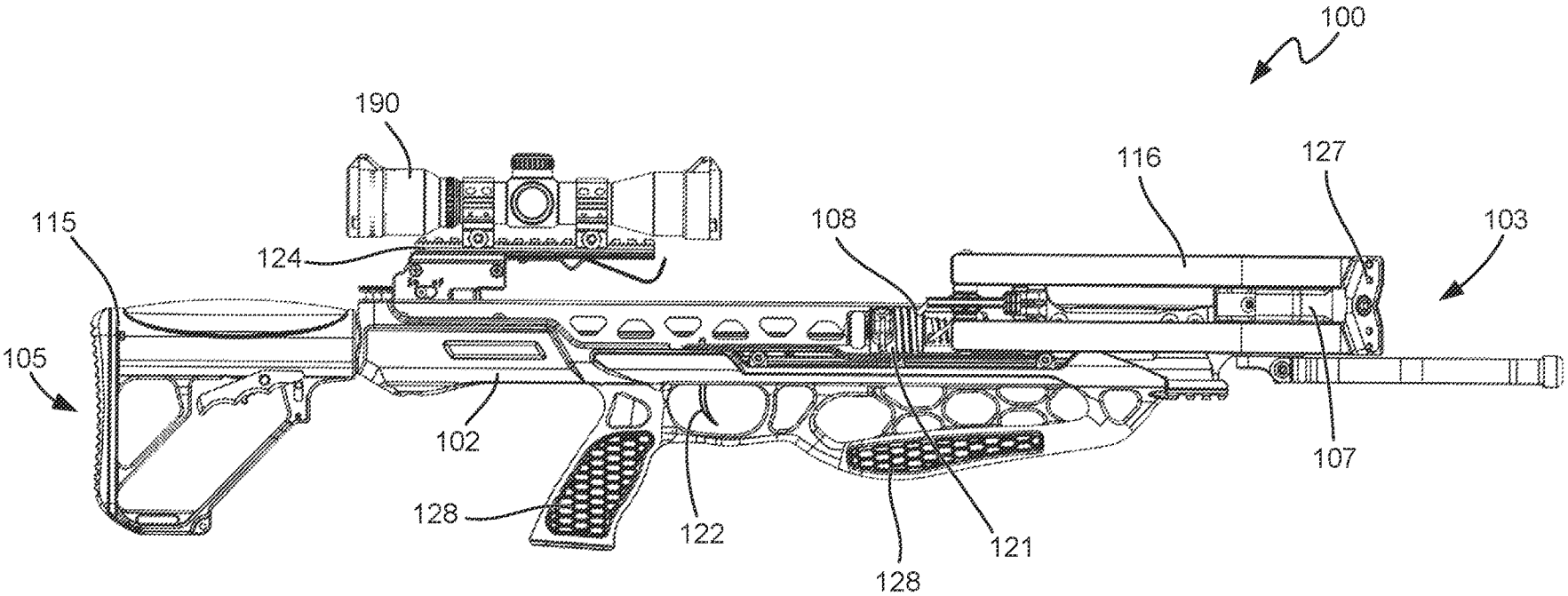
FIG. 3 is another side view of the crossbow of FIG. 1.
Figure 4:
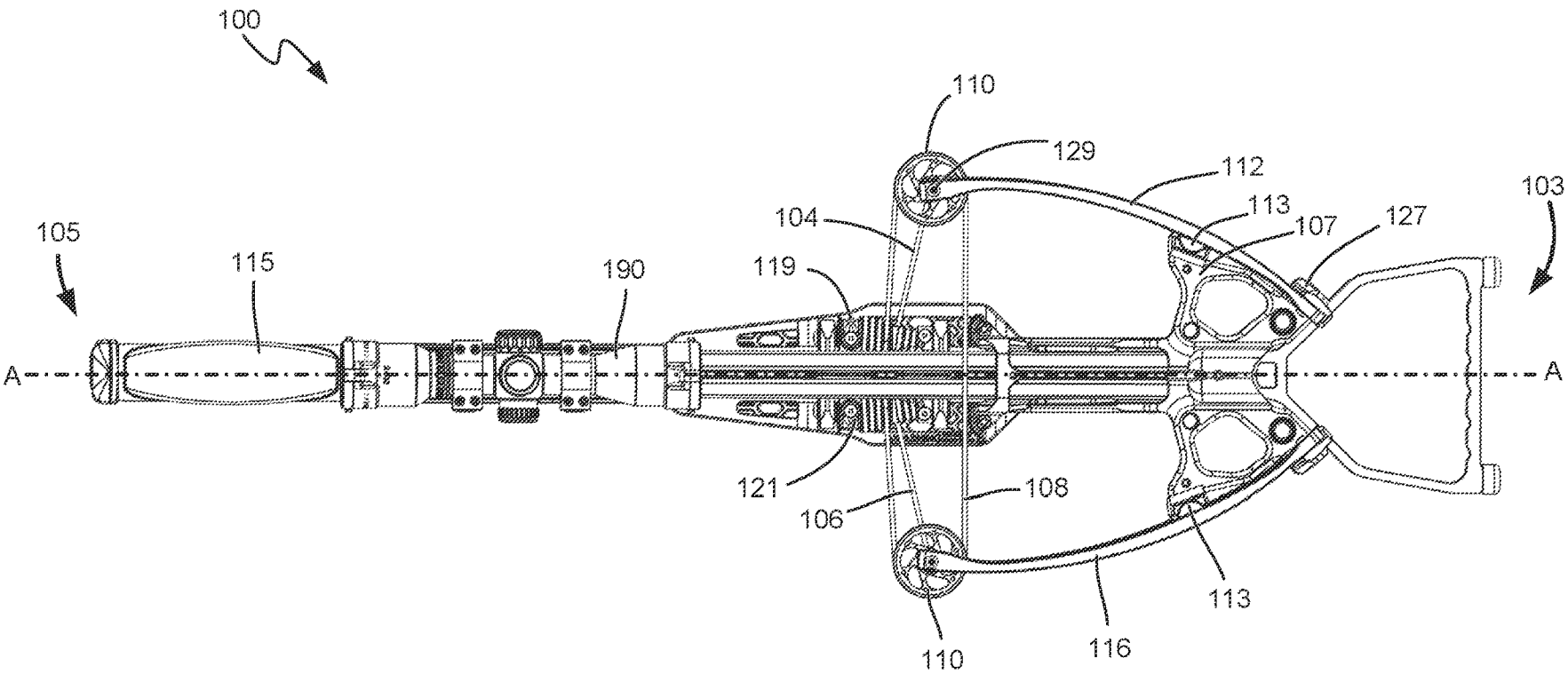
FIG. 4 is a top view of the crossbow of FIG. 1.
Figure 5:
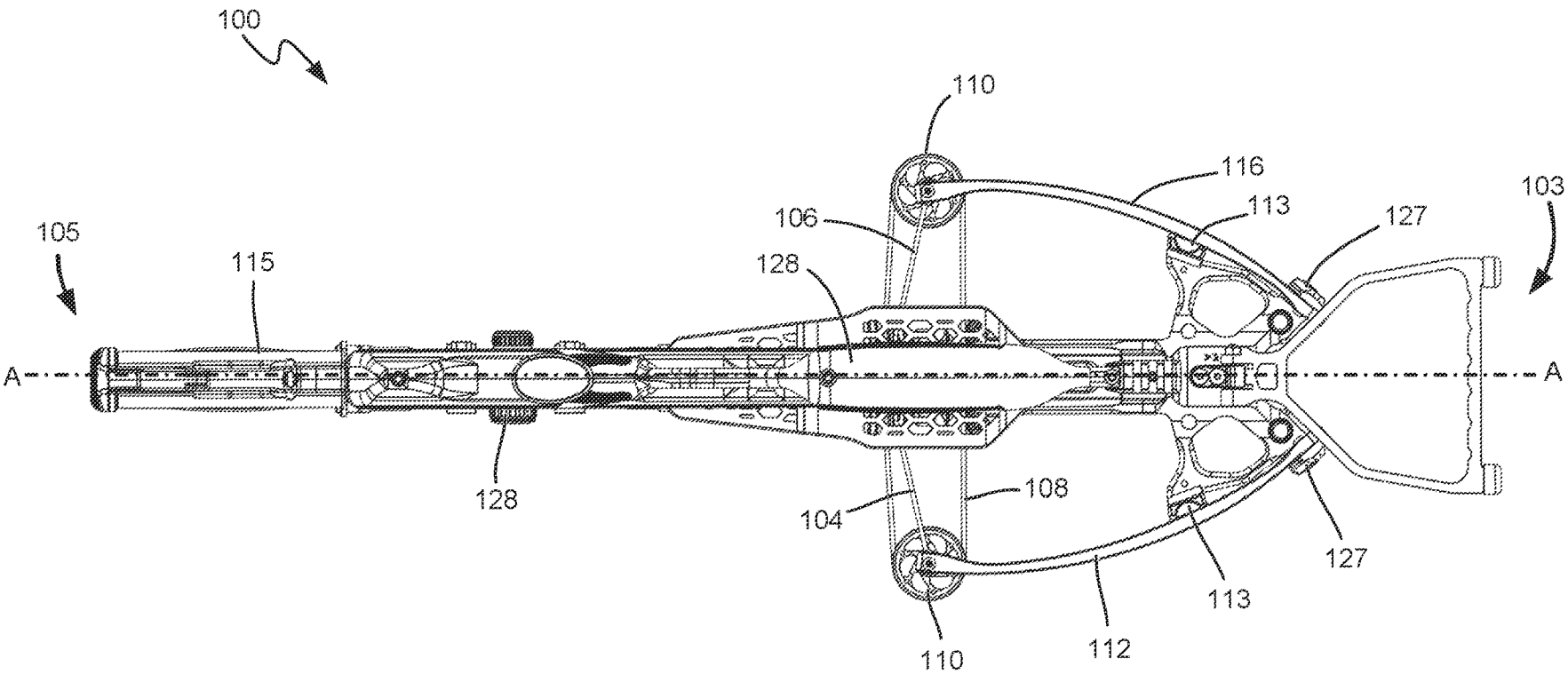
FIG. 5 is a bottom view of the crossbow of FIG. 1.
Figure 6:
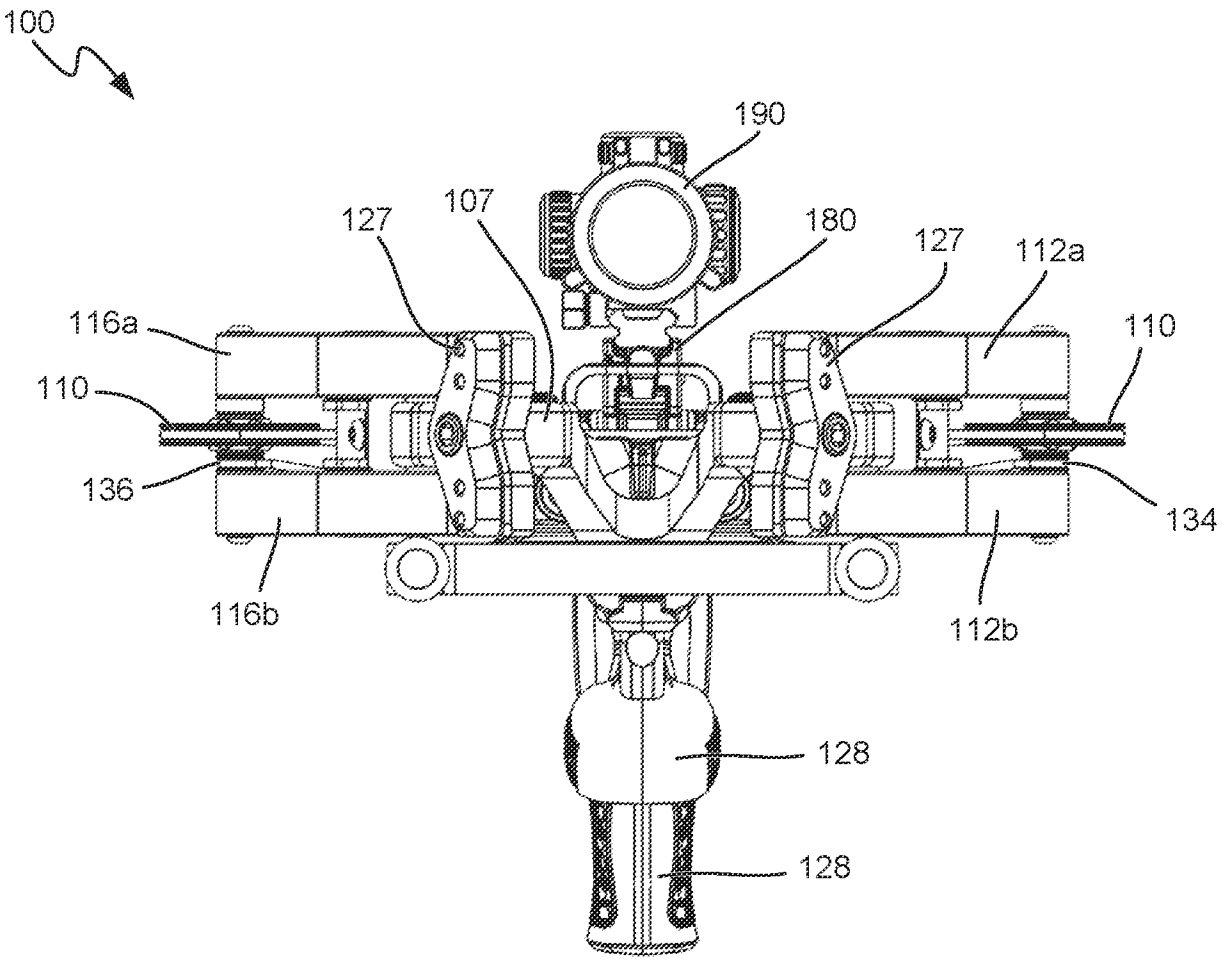
FIG. 6 is a front view of the crossbow of FIG. 1.
Figure 7:
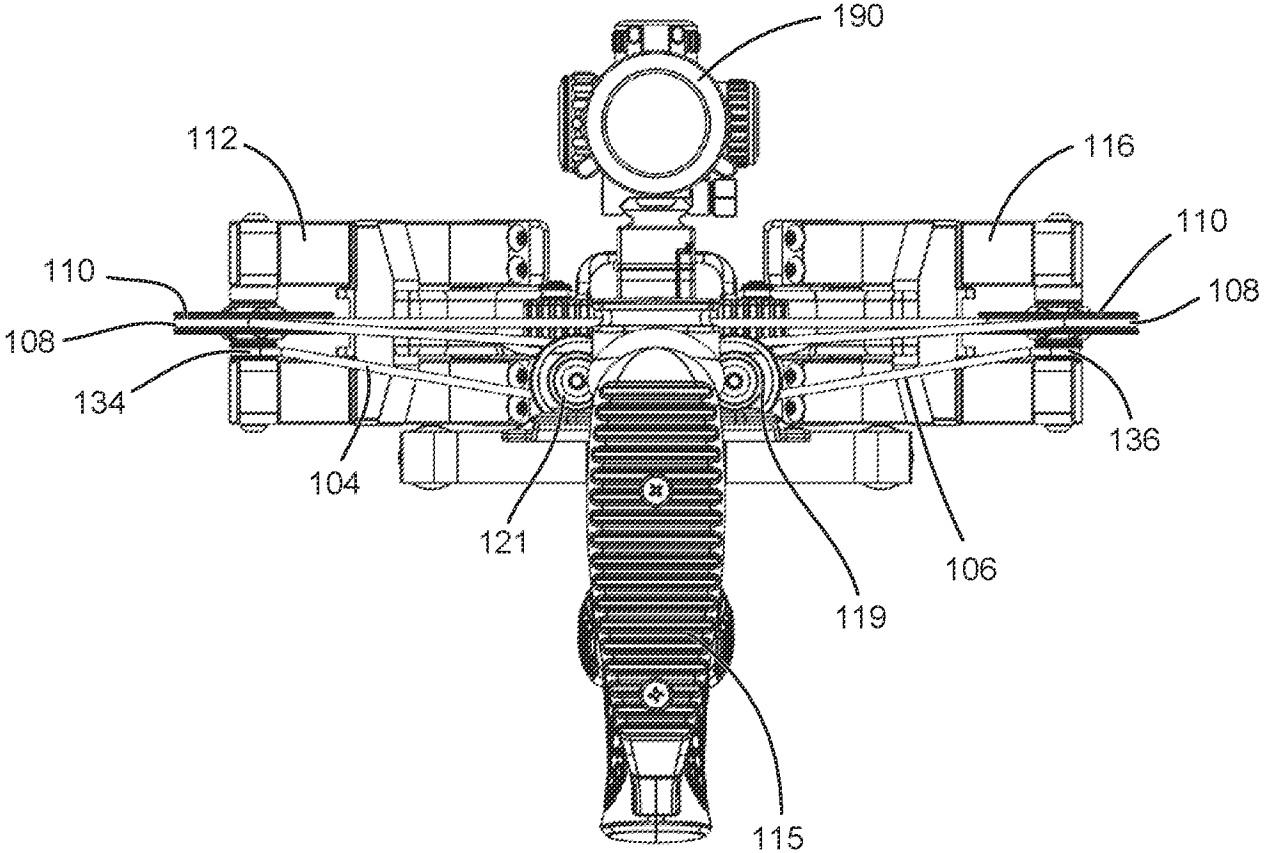
FIG. 7 is a rear view of the crossbow of FIG. 1.

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The crossbows disclosed herein can be used in a variety of different arrangements to improve efficiency, improve balance, improve safety, shoot different projectiles, and improve accuracy. The draw weight of the drawstring is the pulling force required to draw the drawstring to a rear of the crossbow. By introducing a mechanical advantage to the draw weight of the drawstring, power cables can load powerful flexible limbs with less pulling force. Because a powerful flexible limb can be loaded, the flexible limb can power the drawstring more aggressively (i.e., move faster) toward the front of the crossbow when firing, thus leading to firing a projectile at a faster speed.

FIGS. 1-12 show one embodiment of a crossbow 100 according to the principles of the present disclosure. Crossbow 100 can be configured in a variety of different ways without departing from the principles of this disclosure.

In the embodiment shown, crossbow 100 includes a frame 102 to which various components are attached. The frame 102 can be constructed of materials including carbon fiber composite, wood, aluminum, or other suitable materials. As shown, a stock 115 is attached to frame 102 at a rear end 105. In some examples, the stock 115 may be integrally formed with frame 102 as a singular unibody component without departing from the principles of this disclosure. In other examples, stock 115 may be removable. Stock 115 can also be made of a variety of materials, including but not limited to those materials used to make frame 102.

In some examples, crossbow 100 does not include a stock 115 and can be fired like a pistol. In other examples, frame 102 has a multiple-piece construction. Frame 102 may include a variety of mounting points (which can be part on one or more rails etc.) for various modular accessories such as a quiver, a scope, a flashlight, or other attachments.

In the embodiment shown, a riser 107 is attached to frame 102. Riser 107 provides additional mounting locations for components, including flexible limbs 112, 116 and string stops 176, 178. In certain embodiments, riser 107 and frame 102 may be formed as a singular component without departing from the principles of this disclosure. Riser 107 is made of a glass/carbon fiber composite but may alternatively be made of aluminum or other suitable materials.

Frame 102 further includes a projectile axis A for supporting and guiding a projectile. In some examples, a projectile rest may be included that is positioned along projectile axis A to provide additional support for the projectile. In some examples, the projectile rest can include bristles or arms to cradle the projectile.

The crossbow 100 can include a plurality of accessory rails 124. In some examples, the accessory rail 124 can be a picatinny rail. In some examples, the accessory rail 124 is configured to receive a sighting apparatus, such as a scope 190. In some examples, one of the accessory rails 124 is configured to receive a lighting device, such as a flashlight. In some examples, one of the accessory rails 124 is configured to receive a quiver.

The grip 128 provides a point of support for a user of the crossbow 100. The grip 128 can be held by the user's hand, including when operating the trigger assembly 122. The grip 128 assists the user in stabilizing the crossbow 100 during firing and handling. In some embodiments, the grip 128 is mounted to the frame 102. In some embodiments, the crossbow 100 has a plurality of grips 128 mounted to the frame 102.

Crossbow 100 includes a frame 102, a riser 107, a first power cable 104, and a first flexible limb 112. Crossbow 100 further includes a second power cable 106, and a second flexible limb 116. In certain embodiments, crossbow 100 may include additional or fewer power cables without departing from the principles of this disclosure. Crossbow 100 also includes a first cam 119 and a second cam 121. A drawstring 108 is connected to and extends between the cams 119, 121. In some embodiments, additional or fewer cams may be included without departing from the principles of this disclosure.

The Projectile moves within a horizontal projectile plane and travels along a projectile axis A when crossbow 100 is fired. Crossbow 100 fires the projectile from a front end 103 of the crossbow. In certain examples, crossbow 100 is generally symmetrical about the projectile axis A.

In certain embodiments, the power cables 104, 106 are coupled to the flexible limbs 112, 116 and the cams 119, 121. The flexible limbs 112, 116 are the source of power for crossbow 100. However, the power source can be provided by any suitable source including but not limited to—spring(s) and/or motor(s). In certain embodiments, the power cables 104, 106 are replaceable, such as when they are worn, for example. In some examples, the crossbow 100 is provided without power cables 104, 106, and the power cables 104, 106 can be subsequently added by a user or technician. The power cables 104, 106 can be constructed of traditional bowstring material such as, but not limited to, composite and/or natural fibers.

Figure 9:
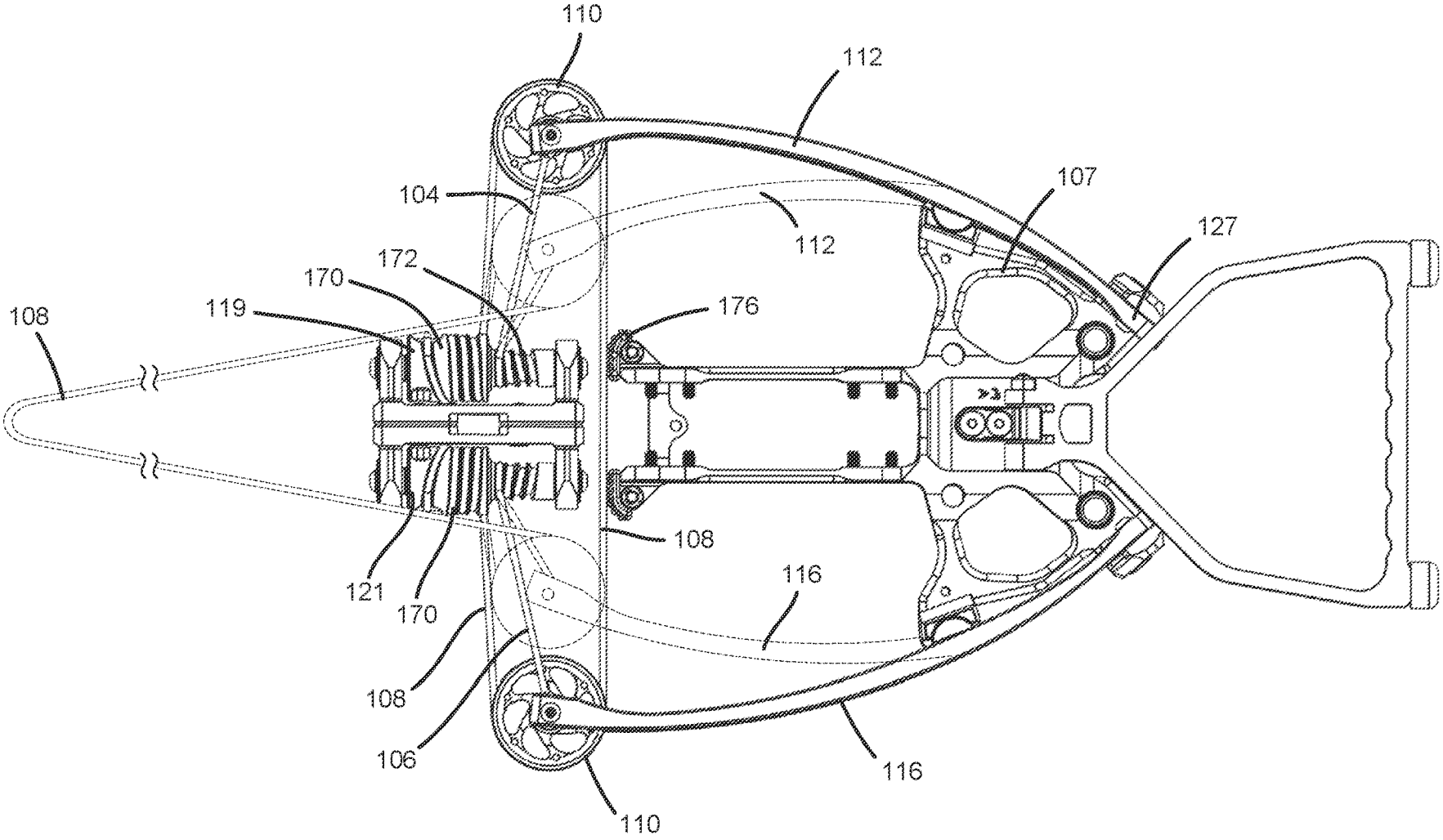
FIG. 9 is top view of the riser, flexible limbs, and cam and pulley system for the crossbow of FIG. 1, shown in the undrawn position and also showing the drawn position of the flexible limbs.
Figure 10:
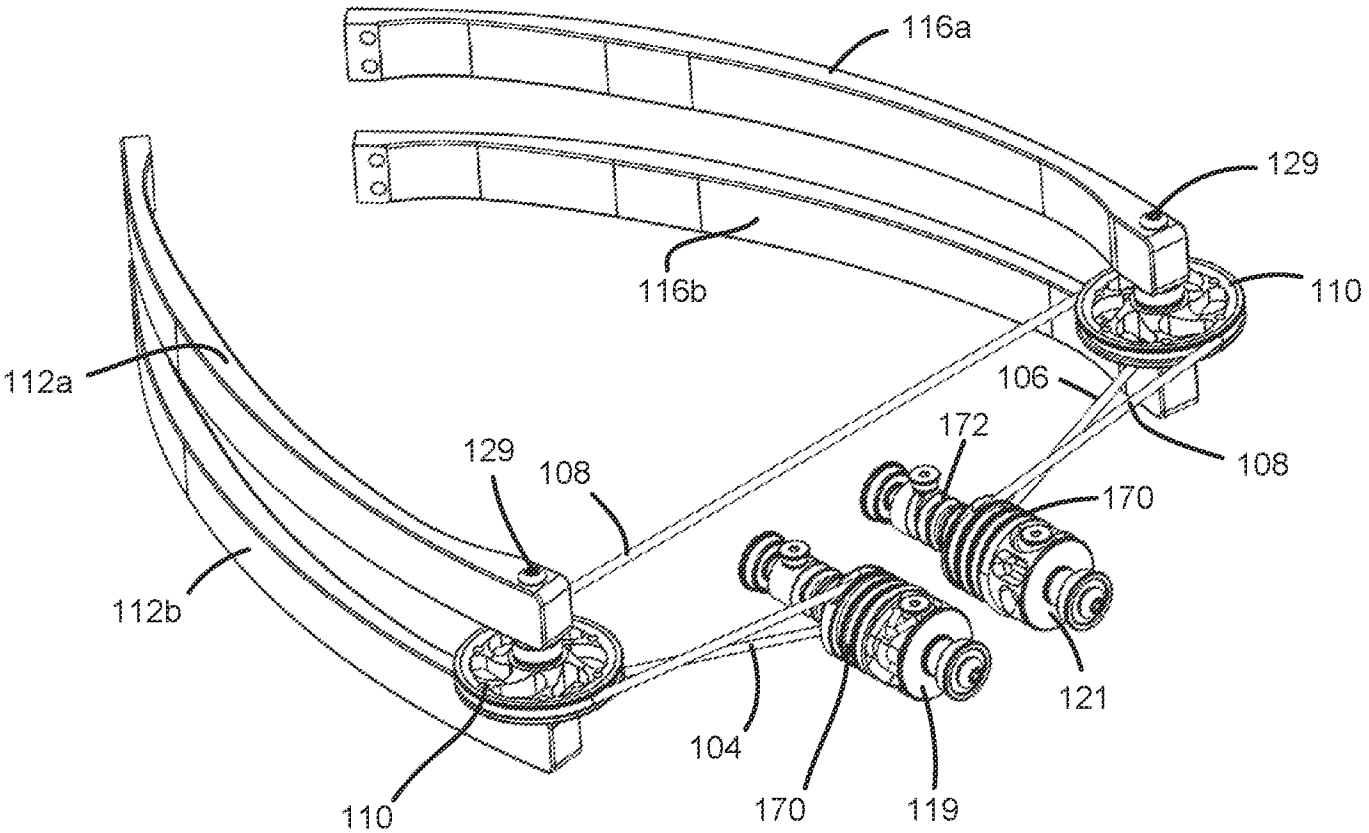
FIG. 10 is a rear perspective view of the flexible limbs and cam and pulley system for the crossbow of FIG. 1, shown in the undrawn position.
Figure 11:
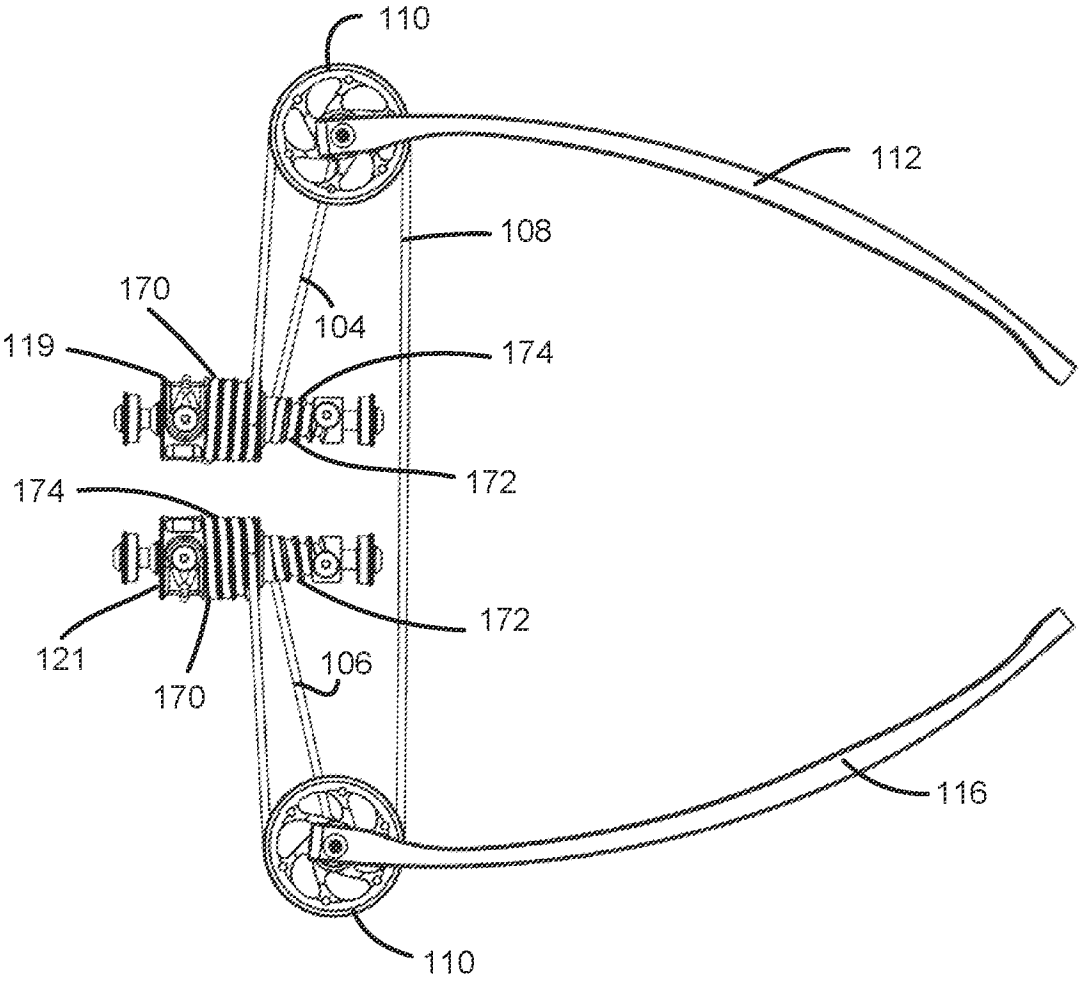
FIG. 11 is a top view of the flexible limbs and cam and pulley system for the crossbow of FIG. 1, shown in the undrawn position.
Figure 12:
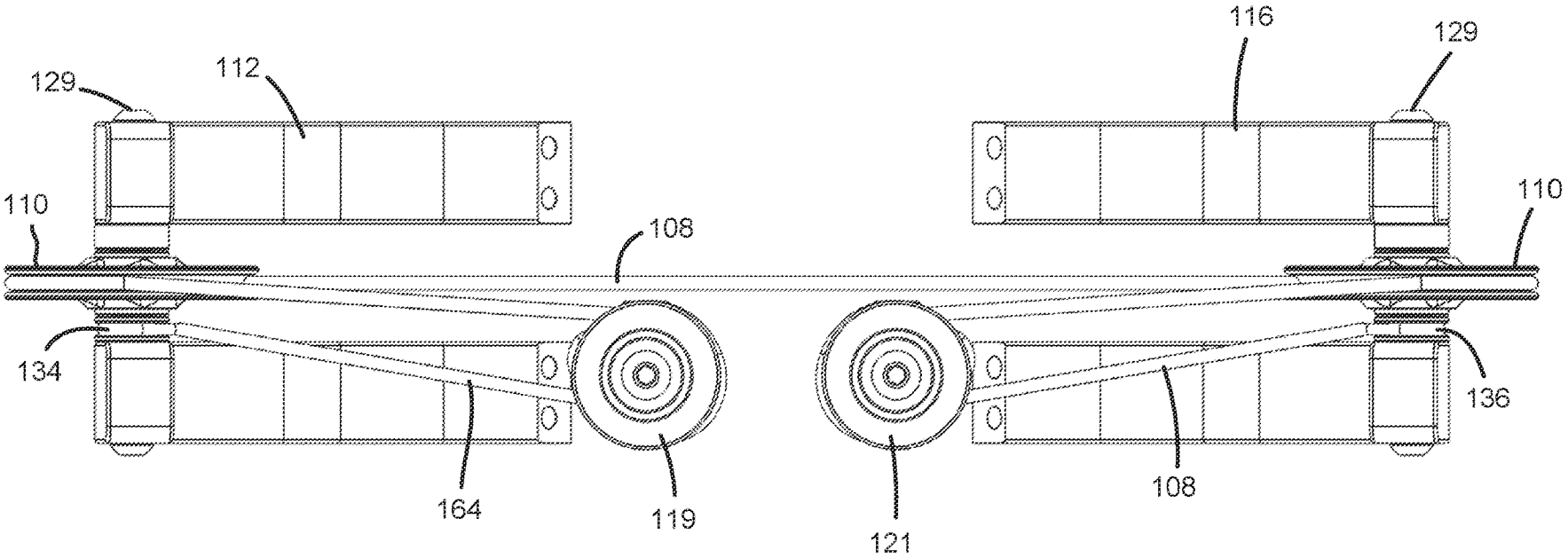
FIG. 12 is a rear view of the flexible limbs and cam and pulley system for the crossbow of FIG. 1, shown in the undrawn position.
Figure 13:
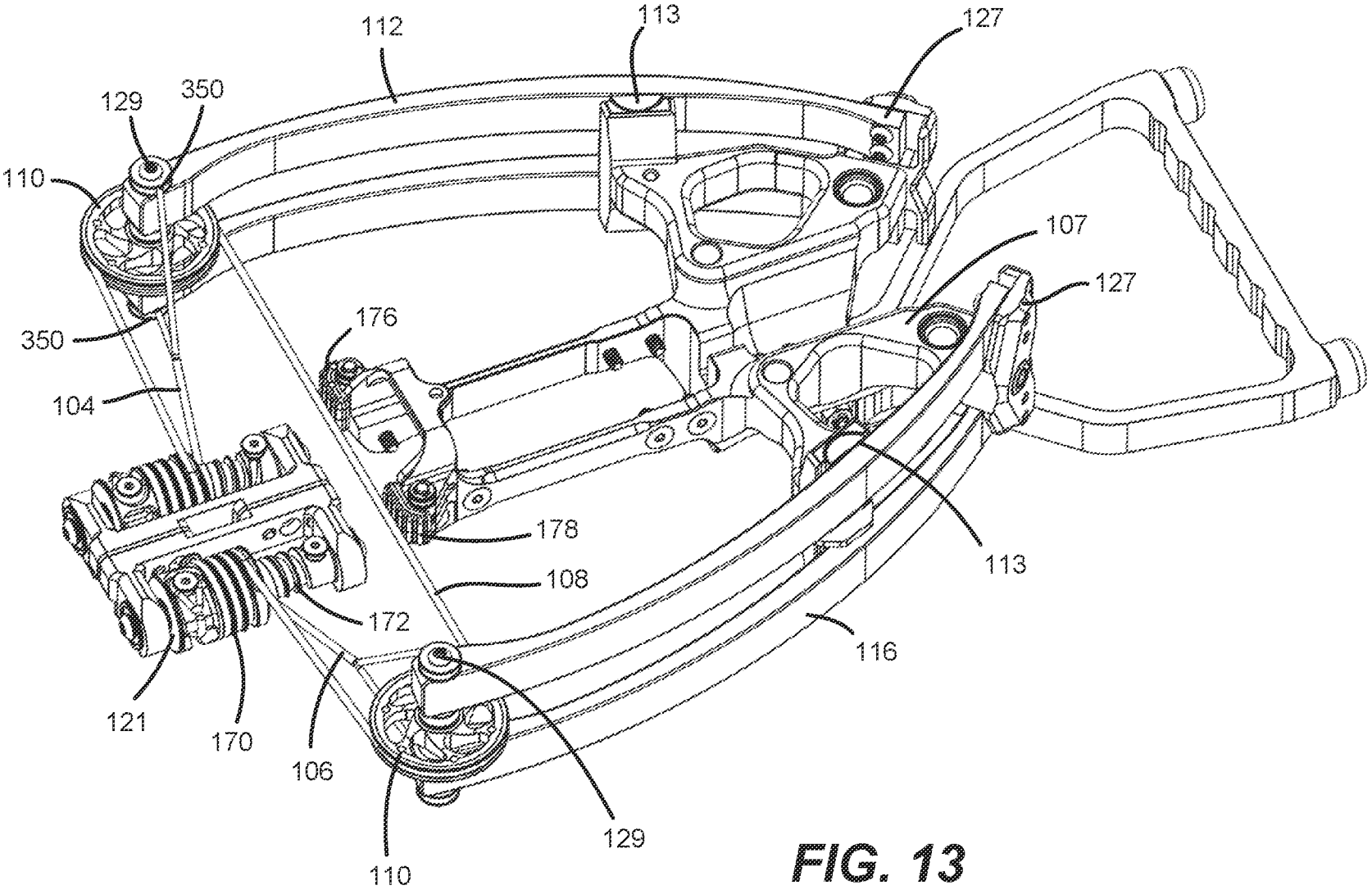
FIG. 13 is a rear perspective view of one embodiment of a riser, flexible limbs, and cam and pulley system for the crossbow of FIG. 1, shown in the undrawn position.
Figure 14:
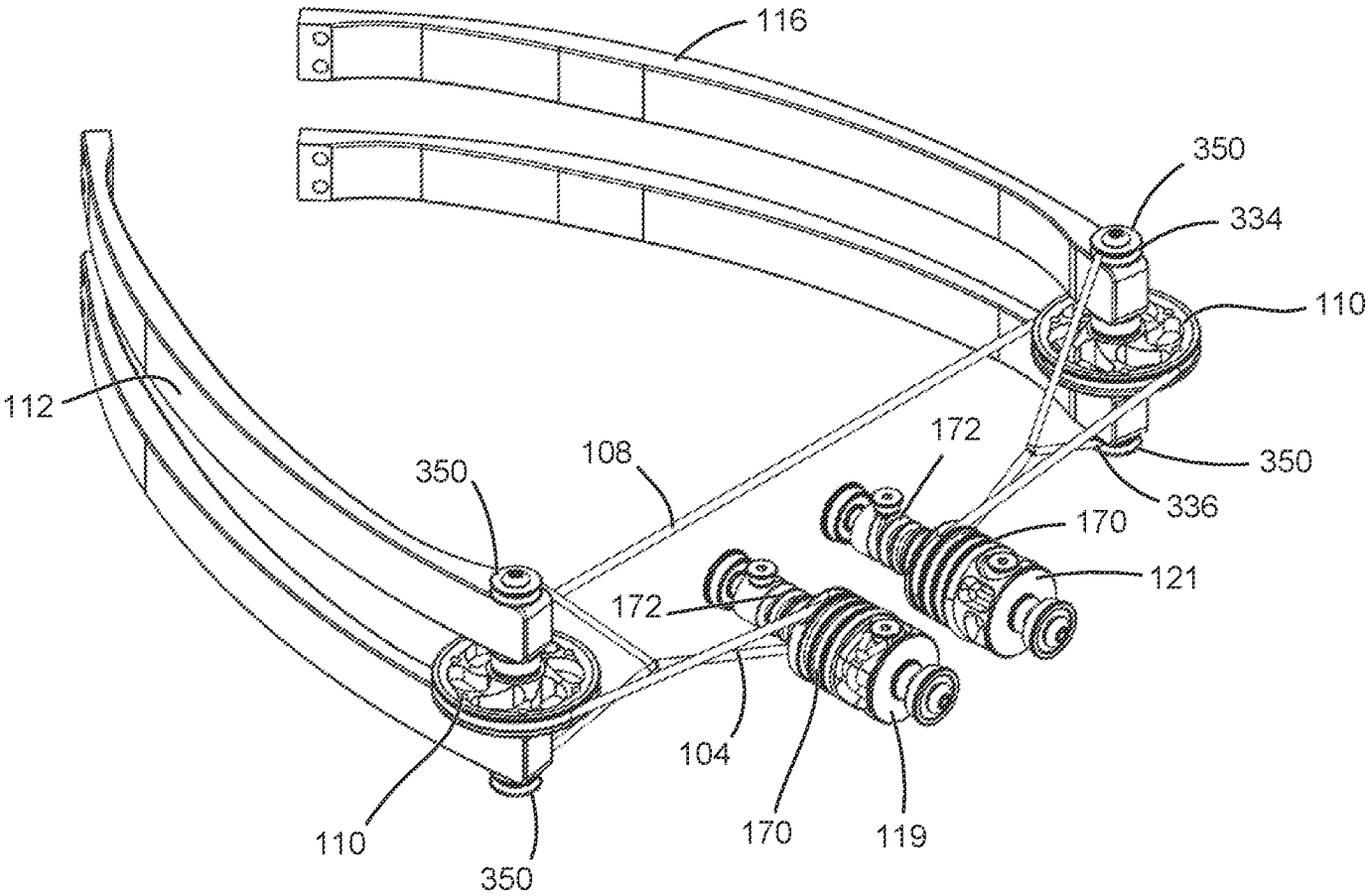
FIG. 14 is a rear perspective view of the flexible limbs and cam and pulley system of FIG. 13, shown in the undrawn position.
Figure 15:
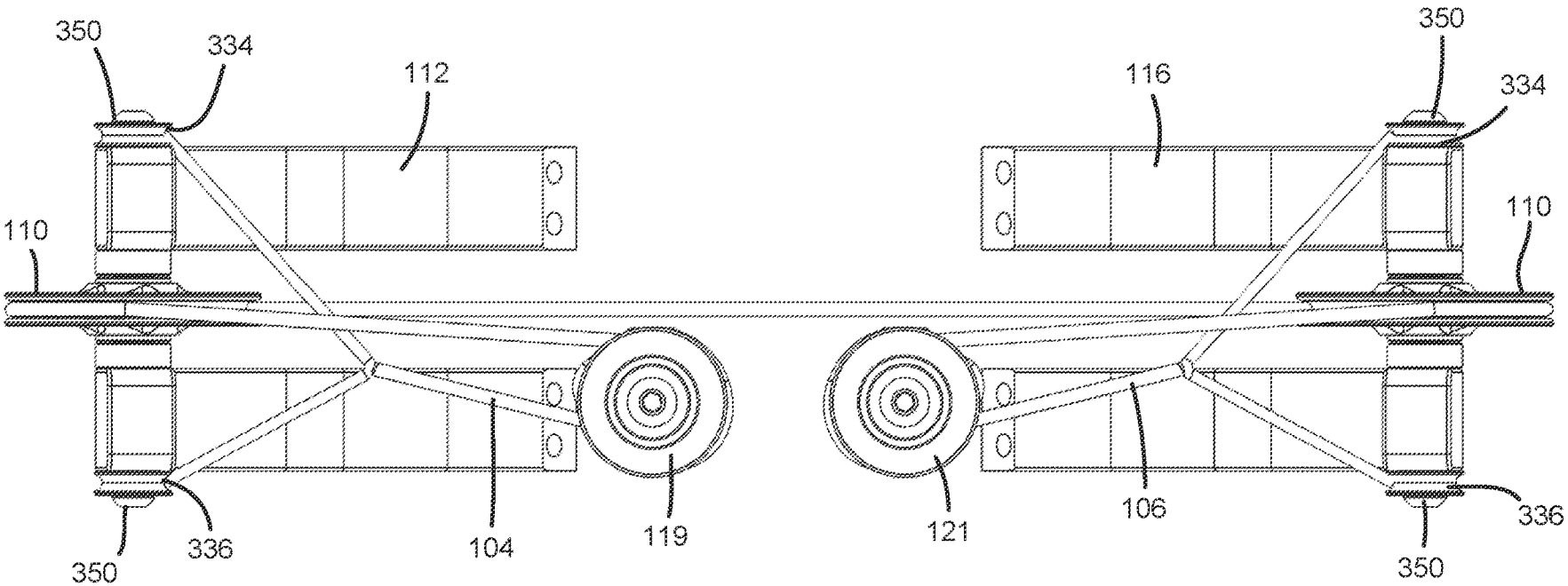
FIG. 15 is a rear view of the flexible limbs and cam and pulley system of FIG. 13, shown in the undrawn position.

FIG. 9 is a top view of the riser 107, flexible limbs 112, 116, and cams 119, 121 of crossbow 100 shown in the undrawn position and also showing the drawn position of the flexible limbs. As shown, crossbow 100 can fire a projectile, such as an arrow. One example of an arrow is a bolt. In certain embodiments, the projectile is an arrow with a pointed tip and fletching to help stabilize the projectile as it moves through the air when the projectile is fired from the crossbow 100.

As shown, when the crossbow 100 is drawn, the power cables 104, 106 cause the flexible limbs 112, 116 to bend toward the projectile axis A, thereby loading the limbs.

Each flexible limb 112, 116 is attached to riser 107 at a first end 127. Second ends 134, 136 of power cables 104, 106 are attached to second ends 129 of the flexible limbs 112, 116. Limb pivots 113 are positioned between the first ends 127 and second ends 129 of the flexible limbs 112, 116. In the embodiment shown, limbs 112, 116 are elastic and spring-like in nature. As shown, limbs 112, 116 are made of a glass/carbon fiber composite, but any other suitable material may be used without departing from the principles of this disclosure.

Limbs 112, 116 extend in an outward direction from the projectile axis A and in a rearward direction toward the rear end 105 of the crossbow 100. The limbs 112, 116 are positioned at either side of the projectile axis A such that the projectile passes between the limbs 112, 116 when the crossbow 100 is fired.

In some examples, the limbs 112, 116 extend in an outward direction from the projectile axis A and/or in a forward direction toward the front end 103 of the crossbow 100. In some examples, the limbs 112, 116 extend in an upward direction from projectile axis A and/or in a forward direction toward the front end 103 of the crossbow 100. In some examples, the limbs 112, 116 extend in an upward direction from projectile axis A and/or in a rearward direction toward the rear end 105 of the crossbow 100. Limbs 112, 116 may be positioned in a variety of different ways relative to the projectile axis A without departing from the principles of this disclosure.

Crossbow 100 has three separate cables—two identical power cables 104, 106 and a drawstring 108—coupled together by cams 119, 121. Cams 119, 121 are rotatably attached to frame 102 and positioned on opposite sides of projectile axis A Cams 119, 121 each include an axis of rotation that is substantially parallel to projectile axis A In certain alternative embodiments, the axis of rotation of cams 119, 121 may be positioned at an angle between zero degrees (0°) and ninety degrees (90°) in either the vertical or horizontal direction with respect to projectile axis A without departing from the principles of this disclosure. In certain embodiments, cams 119, 121 may also be positioned above or below the projectile axis A relative to the frame. As shown, cams 119, 121 are positioned below projectile axis A Orienting the cams 119, 121 so that the cam axis of rotation is substantially parallel to projectile axis A allows the cams to be positioned closer to the frame than would be possible if the cam axis of rotation were perpendicular to the projectile axis.

As shown, each cam 119, 121 includes a larger diameter portion 170 and a smaller diameter portion 172. One larger diameter portion 170 and one smaller diameter portion 172 are coaxial and—in the embodiment shown—are integrally formed as one cam 119, 121. Both of the smaller diameter portions 172 and larger diameter portions 170 include helical grooves 174 that guide the power cables 104, 106 and drawstring 108 as they selectively wind around the cam 119, 121. By decreasing the diameter of the larger diameter portion 170 and smaller diameter portion 172 of cams 119, 121 while maintaining the necessary arc lengths for helical grooves 174, the overall mass moment of inertia representing each cam, 119 and 121, can be reduced and the angular acceleration is thereby increased. This effect can lead to improvements in dynamic efficiencies and increased performance attributes as compared to more conventional cam sizes and arrangements.

Smaller diameter portions 172 provide anchor locations to power cables 104, 106 and drawstring 108 is connected to and extends between the larger diameter portions 170. In certain embodiments, power cable 104, 106 and drawstring 108 selectively wind around cams 119, 121 a plurality of complete rotations. In the embodiment shown, the diameters of power cables 104, 106 and drawstring 108 are the same, so the helical grooves 174 are the same size, whether they are on the larger diameter portion 170 or smaller diameter portion 172. In certain embodiments, however, the cables 104, 106 and drawstring 108 may differ in diameter. As such, helical grooves 174 may vary in size to accommodate cables of different diameters.

Each cam 119, 121 relies on the principle of wheel and axle mechanical advantage. The smaller diameter portion 172 and the larger diameter portion 170 rotate at the same rate and complete one full rotation in the same period of time. However, due to the size difference in the radius of the wheel and axle-larger diameter portion 170 and smaller diameter portion 172, respectively—the distance the two parts rotate through is different. The basic equation for wheel and axle ideal mechanical advantage is $$IMA = \frac{R}{r},$$

with R=radius of the larger diameter portion 170 and r=radius of the smaller diameter portion 172. Of course, in the real world some of the advantage is lost due to the friction of the system, but it is sufficient to illustrate the wheel-axle principle as shown in FIG. 23. The mechanical advantage of the cam 119, 121 can be selected by choosing the radii R and r, and may vary as desired.

In certain embodiments, limb pulleys 110—which freely rotate—are positioned near the ends of flexible limbs 112, 116 and can freely rotate to guide the drawstring 108 as it extends from the larger diameter portions 170 on cams 119, 121 and across projectile axis A. In certain embodiments, string stops 176, 178 are positioned on either side of projectile axis A limit how far the drawstring can travel toward the front 103 of crossbow 100 when a projectile is fired. In the embodiment shown, string stops 176, 178 are mounted to riser 107, but may alternatively be mounted to the frame 102. In certain embodiments string stops 176, 178 may be integrally formed in either the riser 107 or the frame 102. The power cables 104, 106 are attached at first ends to the flexible limbs 112, 116 and at second ends are attached to the smaller diameter portion 172 of the cams 119, 121.

Figure 8:
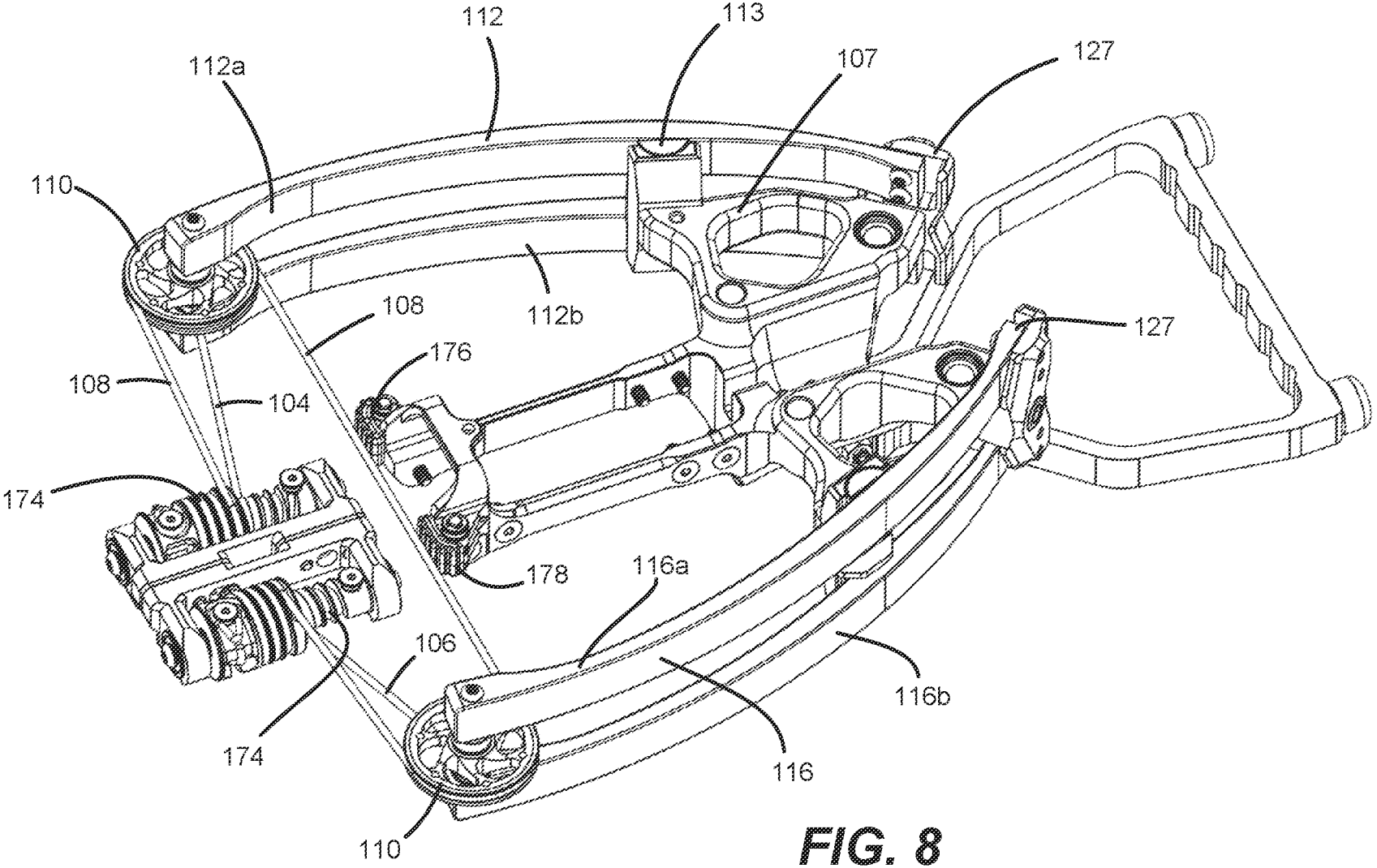
FIG. 8 is a rear perspective view of a riser, flexible limbs, and cam and pulley system for the crossbow of FIG. 1, shown in the undrawn position.

FIG. 8 shows a top detail view of a portion of the crossbow 100 including the riser but with the frame 102 removed and the power cables 104, 106 and drawstring 108 undrawn. FIG. 9 shows a top view of the same portion of crossbow 100, with power cables 104, 106 and drawstring 108 drawn. As shown, the first and second limbs 112, 116 each include separate members 112*a*/112*b*, 116*a*/116*b*. The separate members of each of the first and second limbs 112, 116 are configured to flex together by way of the power cable 104. It is considered within the scope of the present disclosure that the first and second limbs 112, 116 can include any number of separate members.

In certain embodiments, when crossbow 100 is drawn—with drawstring 108 cocked and ready to fire—power cables 104, 106 are wound around smaller diameter portions 172. In certain embodiments, the power cables 104, 106 are wound around smaller diameter portions 172 a plurality of complete rotations. As drawstring 108 is drawn, the cable unwinds from larger diameter portions 170 of cams 119, 121. The unwinding of larger diameter portions 170 causes cams 119, 121 to rotate, thereby causing power cables 104, 106 to wind around smaller diameter portions 172.

As shown in FIG. 9, when crossbow 100 is undrawn—with drawstring 108 uncocked—power cables 104, 106 are attached to the smaller diameter portions 172 but are not wound around the smaller diameter portions significantly. In certain embodiments, power cables 104, 106 may be wound around the smaller diameter portions 172 any suitable amount without departing from the principles of this disclosure. Meanwhile, when the crossbow 100 is undrawn, drawstring 108 is attached to larger diameter portions 170 and wound around them—in certain embodiments—a plurality of complete rotations. Drawstring 108 may be wound around larger diameter portions 170 any suitable number of times without departing from the principles of this disclosure.

The mechanical advantage between larger diameter portions 170 and smaller diameter portions 172 reduces the draw weight necessary to draw the drawstring 108 to the cocked position. To draw crossbow 100, it is stabilized and drawstring 108 is pulled to the rear end 105 of the crossbow 100. A cocking system may used to draw the drawstring 108 from an uncocked position to a cocked position. One example of a cocking system in accordance with the present disclosure is described in U.S. Pat. No. 10,077,965, the entirety of which is incorporated herein by reference for all purposes. In certain alternative embodiments, an arming device, the user's arm, or other like mechanism can be used to draw the drawstring 108.

Two alternative embodiments of power cables 104, 106 are shown in FIGS. 13-15 and 16-18, respectively. In the embodiment shown in FIGS. 13-15, second ends 334, 336 of power cables 104, 106 are split such that there are two attachment points 350 at second ends 129 of the flexible limbs 112, 116. Splitting the second ends 334, 336 more evenly distributes the force applied to the flexible limbs 112, 116 by the power cables 104, 106.

Figure 16:
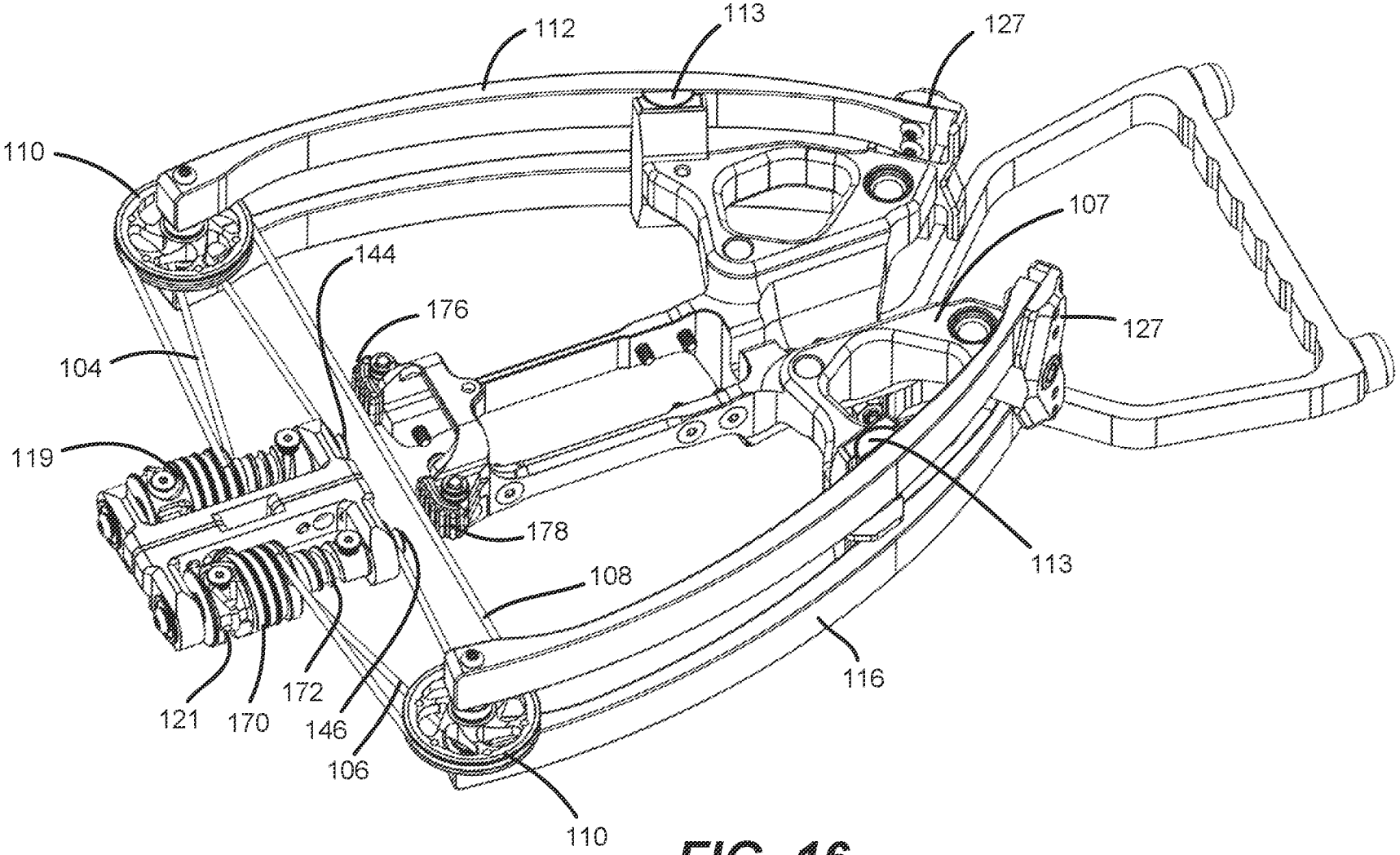
FIG. 16 is a rear perspective view of one embodiment of a riser, flexible limbs, and cam and pulley system for the crossbow of FIG. 1, according to the principles of the present disclosure, showing the crossbow in an undrawn position.
Figure 17:
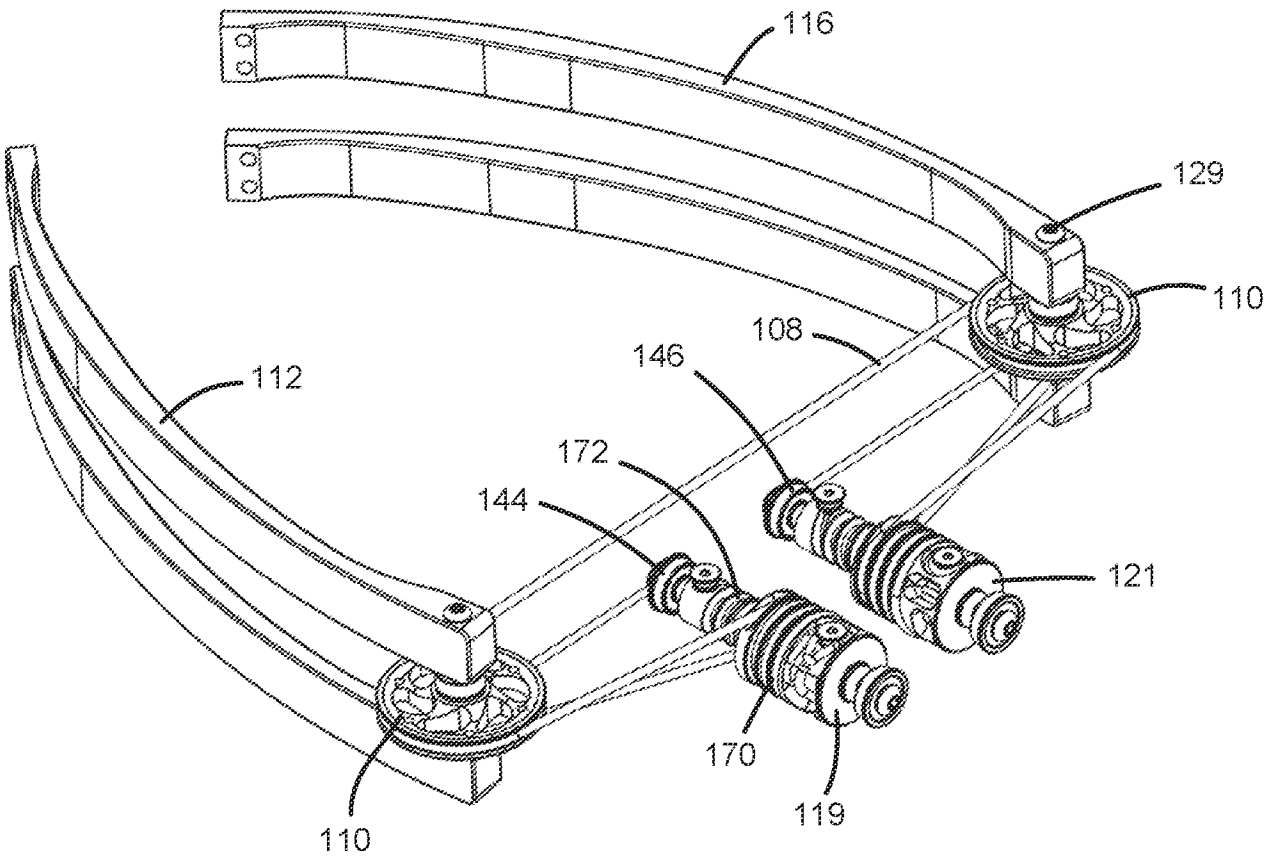
FIG. 17 is a rear perspective view of the flexible limbs and cam and pulley system of FIG. 16, shown in the undrawn position.
Figure 18:
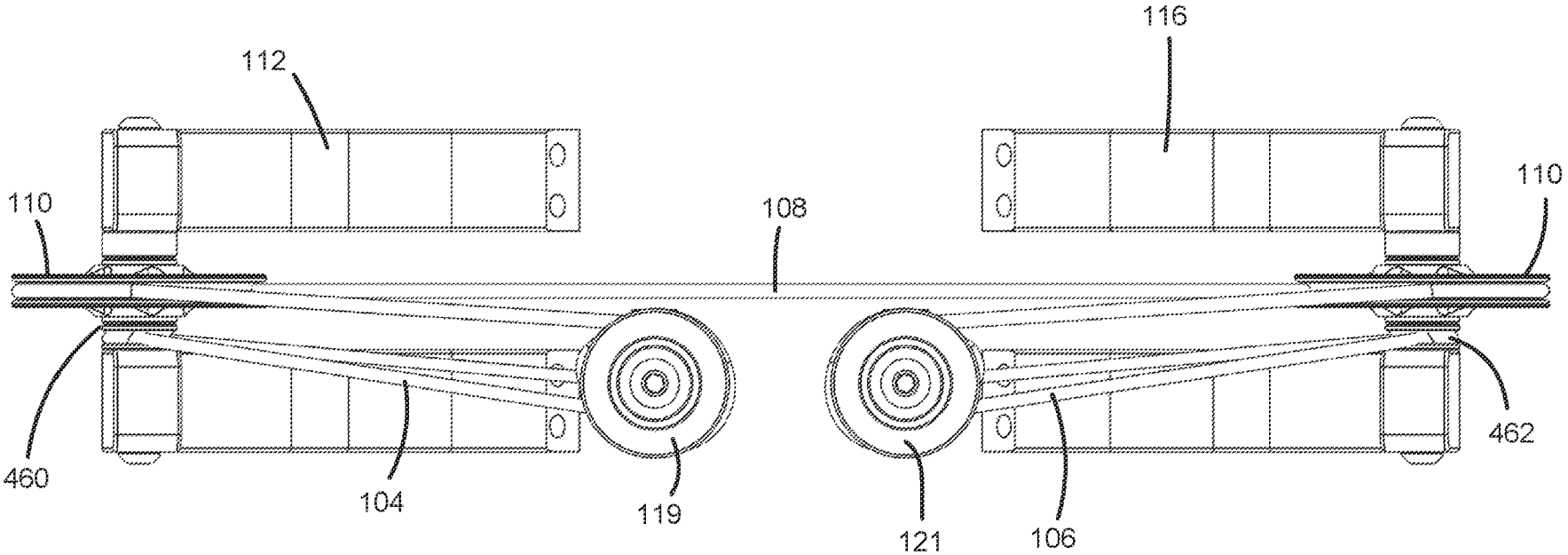
FIG. 18 a rear view of the flexible limbs and cam and pulley system of FIG. 16, shown in the undrawn position.
Figure 19:
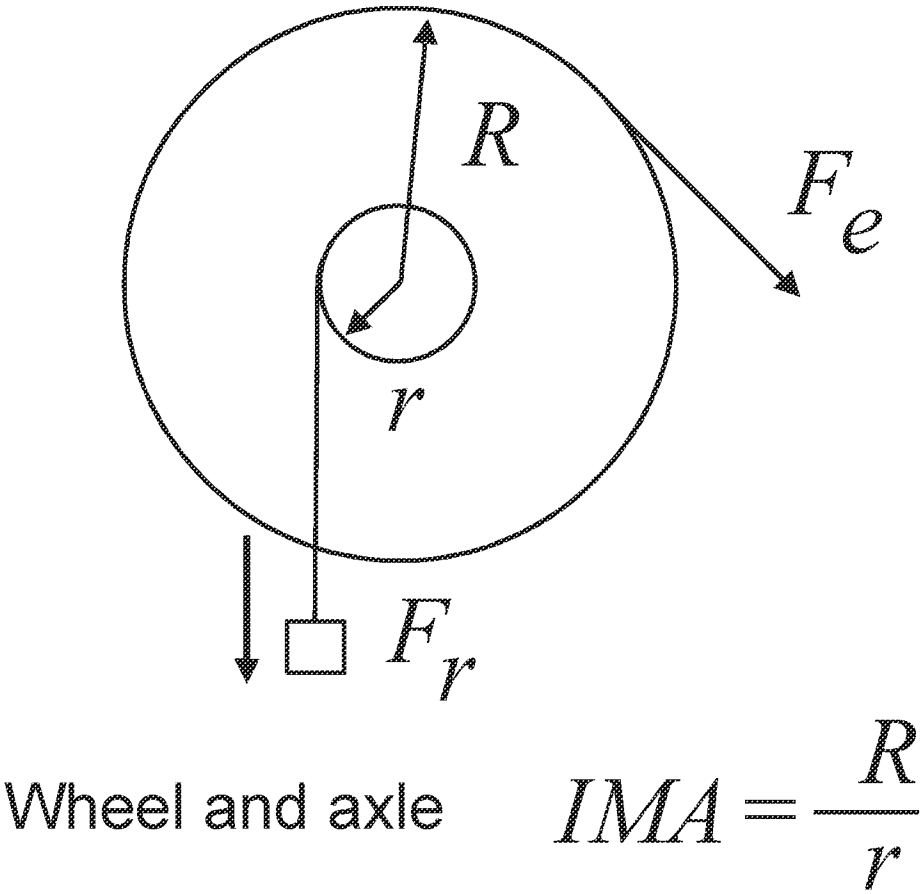
FIG. 19 is a diagram illustrating the principle of wheel-axle mechanical advantage.

In the embodiment shown in FIGS. 16-18, first ends 140, 142 of power cables 104, 106 are attached to opposite sides of frame 102 at mounting locations 144, 146. Power cables 104, 106 are routed around power cable pulleys 460, 462—which are positioned at the second ends 129 of the flexible limbs 112, 116—and back to smaller diameter portions 172 of cams 119, 121. Routing power cables 104, 106 around the power cable pulleys 460, 462 reduces the force needed to draw the drawstring 108 to cock the crossbow 100.

In certain embodiments, crossbow 100 includes a cocking system that includes a drawstring holder 180. In certain embodiments, the drawstring holder 180 slides along frame 102 toward the riser 107 to engage the drawstring 108 while it is in the undrawn position. That is, the drawstring holder 180 is slidably attached to frame 102 and moves in a single degree of freedom along the projectile axis A. The engagement of drawstring holder 180 with the frame 102 substantially prevents the cable carrier from moving in any other direction relative to projectile axis A and the riser 107.

After drawstring holder 180 has captured the drawstring 108 and is engaged with trigger assembly 122, it is almost ready to fire. Next, a user loads a projectile onto crossbow 100 along the projectile axis A and engages with the drawstring 108, which is still captured by the drawstring holder 180.

Once the projectile is engaged with drawstring holder 180, it is ready to fire. A user may actuate trigger assembly 122 to fire the crossbow 100. The trigger assembly 122 is in communication with the drawstring holder 180 so that upon activation of the trigger assembly 122 when firing (e.g., pulling the trigger toward the rear end 105 of the crossbow 100), the trigger assembly 122 moves portions the drawstring holder 180 and the drawstring 108 is released and free to travel toward the front end 103 of the crossbow 100. In some examples, the trigger assembly 122 includes a safety and/or anti-dry fire protection. As the drawstring 108 travels toward the front end 103 it carries the projectile with it until the projectile is fired from the front end 103 of crossbow 100.

FIGS. 8-12 show the arrangement of the cables 104, 106, drawstring 108, limb pulleys 110, and cams 119, 121 in greater detail. The limb pulleys 110 and cams 119, 121 may include grooves sized and shaped to receive a power cable 104, 106 or drawstring 108. The limb pulleys 110 and cams 119, 121 are made from a material to minimize any slippage between the power cables 104, 106 and drawstring 108 and the pulleys and cams. Any suitable material may be used without departing form the scope of the present disclosure. For example, the groove can be textured, e.g., lined with a high grip material or mechanical feature to grab the power cables 104, 106 and drawstring 108. In certain embodiments, the limb pulleys 110 may be constructed of low friction material. In such an example, the limb pulleys 110 can be fixed rather than freely rotating. As shown, limb pulleys 110 are shown as circular, but the pulleys can also have other shapes, such as lobe-shaped.

Although the embodiments herein described are what are perceived to be the most practical and preferred embodiments, this disclosure is not intended to be limited to the specific embodiments set forth above. Rather, modifications may be made by one of skill in the art of this disclosure without departing from the spirit or intent of the disclosure.

What is claimed is:

1. A crossbow comprising:

a frame having a projectile axis extending between a front and a rear of the crossbow, wherein a projectile moves along the projectile axis during firing of the crossbow;

a first flexible limb and a second flexible limb, each first and second limb having a first end attached to the frame and a second end, wherein the first and second flexible limbs are in an unloaded position when the crossbow is undrawn and in a loaded position when the crossbow is drawn;

a first cam attached at a first frame side, wherein the first cam has a larger diameter portion and a smaller diameter portion, the first cam further including a rotational axis substantially parallel to the projectile axis;

a second cam attached at a second frame side, wherein the second cam has a larger diameter portion and a smaller diameter portion, the second cam further including a rotational axis substantially parallel to the projectile axis;

a first pulley attached at the second end of the first flexible limb;

a second pulley attached at the second end of the second flexible limb;

a first power cable at the first frame side, the first power cable having a first and second end, the first end attached to the smaller diameter portion of the first cam, the second end attached to the second end of the first flexible limb;

a second power cable at the second frame side, the second power cable having a first and second end, the first end attached to the smaller diameter portion of the second cam, the second end attached to the second end of the second flexible limb; and a drawstring having a first and second end, wherein the first end is attached to the larger diameter portion of the first cam and the second end is attached to the larger diameter portion of the second cam.

2. The crossbow of claim 1, further comprising a drawstring holder that selectively receives and retains the drawstring at a rear end of the frame.

3. The crossbow of claim 1, wherein the frame includes a stock positioned at a rear end of the frame, the stock being configured to be positioned against a user's shoulder.

4. The crossbow of claim 1, wherein the smaller diameter portion and larger diameter portion of each cam include grooves that receive one of the first power cable, the second power cable, or the drawstring.

5. The crossbow of claim 1, wherein the larger diameter portion and smaller diameter portions of each cam are coaxial.

6. The crossbow of claim 1, wherein the drawstring wraps at least partially around the larger diameter portions of the cams when the crossbow is undrawn and wherein the first and second power cables wrap at least partially around the smaller diameter portions of the cams when the crossbow is in the loaded position.

7. The crossbow of claim 1, wherein rotation of the first and second cams is synchronized.

8. The crossbow of claim 1, wherein the first and second cams are arranged so that each of their rotational axes are positioned at an angle less than 90 degrees with respect to the projectile axis.

9. The crossbow of claim 1, further including a trigger assembly that releases the drawstring from a drawstring holder when the trigger assembly is activated.

10. The crossbow in claim 1, wherein the power cables and drawstring wind around the cams at least one complete rotation.

11. A crossbow comprising:

a frame including a projectile axis, wherein a projectile moves along the projectile axis during firing of the crossbow, and wherein the projectile is fired from a front end of the frame;

a first flexible limb and a second flexible limb, each first and second flexible limb having a first end attached to the frame and a second end, wherein the first and second flexible limbs are in an unloaded position when the crossbow is undrawn and in a loaded position when the crossbow is drawn;

a first cam attached at a first frame side, wherein the first cam has a larger diameter portion and a smaller diameter portion, the first cam further including a rotational axis substantially parallel to the projectile axis;

a second cam attached at a second frame side, wherein the second cam has a larger diameter portion and a smaller diameter portion, the second cam further including a rotational axis substantially parallel to the projectile axis;

a first power cable at the first frame side, the first power cable having a first and second end, the first end of the first power cable attached to the frame and the second end of the first power cable attached to the smaller diameter portion of the first cam;

a second power cable at the second frame side, the second power cable having a first and second end, the first end of the second power cable attached to the frame and the second end of the second power cable attached to the smaller diameter portion of the second cam;

a drawstring having a first and second end, wherein the first end is attached to the larger diameter portion of the first cam and the second end is attached to the larger diameter portion of the second cam; and wherein the drawstring wraps at least partially around the larger diameter portions of the cams when the crossbow is undrawn and wherein the first and second power cables wrap at least partially around the smaller diameter portions of the cams when the crossbow is in the loaded position.

12. The crossbow of claim 11 further comprising a first and second limb pulley, the first and second power cable pulleys rotatably attached to the second ends of the first and second flexible limbs, wherein the first and second power cables are routed around the first and second power cable pulleys.

13. The crossbow of claim 11, wherein the frame includes a stock positioned at a rear end of the frame, the stock being configured to be positioned against a user's shoulder.

14. The crossbow of claim 11, further comprising a projectile rest positioned at the front end of the frame, the projectile rest being configured to at least partially support the projectile.

15. The crossbow of claim 11, further comprising a drawstring holder that selectively receives and retains the drawstring at a rear end of the frame.

16. The crossbow of claim 11, wherein the smaller diameter portion and larger diameter portion of each cam are coaxial.

17. The crossbow of claim 11, wherein the smaller diameter portion and larger diameter portion of each cam include grooves that receive one of the first power cable, the second power cable, or the drawstring.

18. The crossbow of claim 11, wherein the rotation of the first and second cams is synchronized.

19. The crossbow of claim 11, wherein the first and second cams are arranged so that their individual respective axis are less than 90 degrees with respect to the projectile axis.

20. The crossbow of claim 11, further including a trigger assembly that releases the drawstring from a drawstring holder when the trigger assembly is activated.

21. The crossbow in claim 11, wherein the power cables and drawstring wind around the cams at least one complete rotation.

22. A crossbow comprising:

a frame having a projectile axis, wherein a projectile moves along the projectile axis during firing of the crossbow;

a flexible limb having a first end attached to the frame and a second end, wherein the flexible limb is in an unloaded position when the crossbow is undrawn and in a loaded position when the crossbow is drawn;

a cam attached to the frame, the cam having a larger diameter portion and a smaller diameter portion, wherein the larger diameter portion has a larger diameter than the smaller diameter portion;

the cam further having a rotational axis substantially parallel to the projectile axis; a power cable having a first and second end, the first end attached to the smaller diameter portion and the second end attached to the second end of the limb;

a drawstring having a first and second end, wherein the ends are attached to the larger diameter portion of the cam; and wherein the drawstring wraps around the larger diameter portions of the cam when the crossbow is undrawn and wherein the power cable wraps around the smaller diameter portion of the cam when the crossbow is in the loaded position.

23. The crossbow of claim 22, further comprising a drawstring holder that selectively receives and retains the drawstring at a rear end of the frame.

24. The crossbow of claim 22, further comprising a stock positioned at a rear end of the frame.

25. The crossbow of claim 22, further comprising a trigger assembly that releases the drawstring from a drawstring holder when the trigger assembly is activated.

26. The crossbow of claim 22, wherein the smaller diameter portion and larger diameter portion of the cam is coaxial.

27. The crossbow of claim 22, wherein the smaller diameter portion and larger diameter portion of the cam includes grooves that receive the power cable and the drawstring.

28. The crossbow of claim 22, wherein the cam is a first cam, further comprising:

a second cam;

wherein rotation of the first and second cams is synchronized.

29. The crossbow of claim 22, wherein the cam is arranged so that its individual respective axis is less than 90 degrees with respect to the projectile axis.

30. The crossbow of claim 22, further including a trigger assembly that releases the drawstring from a drawstring holder when the trigger assembly is activated.

31. The crossbow in claim 22, wherein the power cable and the drawstring wind around the cams at least one complete rotation.

32. A draw system for a crossbow having a frame and a projectile axis, the draw system comprising:

a first flexible limb and a second flexible limb, each first and second limb having a first end attached to the frame and a second end, wherein the first and second flexible limbs are in an unloaded position when the crossbow is undrawn and in a loaded position when the crossbow is drawn;

a first cam attached at a first frame side, wherein the first cam has a larger diameter portion and a smaller diameter portion, the first cam further including a rotational axis substantially parallel to the projectile axis;

a second cam attached at a second frame side, wherein the second cam has a larger diameter portion and a smaller diameter portion, the second cam further including a rotational axis substantially parallel to the projectile axis;

a first pulley attached at the second end of the first flexible limb;

a second pulley attached at the second end of the second flexible limb;

a first power cable at the first frame side, the first power cable having a first and second end, the first end attached to the smaller diameter portion of the first cam, the second end attached to the second end of the first flexible limb;

a second power cable at the second frame side, the second power cable having a first and second end, the first end attached to the smaller diameter portion of the second cam, the second end attached to the second end of the second flexible limb; and a drawstring having a first and second end, wherein the first end is attached to the larger diameter portion of the first cam and the second end is attached to the larger diameter portion of the second cam.

33. The draw system of claim 32, wherein the drawstring wraps at least partially around the first and second pulleys.

34. The draw system of claim 32, wherein the drawstring wraps at least partially around the larger diameter portions of the cams when the crossbow is undrawn and wherein the first and second power cables wrap at least partially around the smaller diameter portions of the cams when the crossbow is in the loaded position.

35. The draw system of claim 32, wherein a rotation of the first and second cams is synchronized.

36. The crossbow of claim 32, wherein the first and second cams are arranged so that their individual respective axis are less than 90 degrees with respect to the projectile axis.

37. The crossbow of claim 32, further including a trigger assembly that releases the drawstring from a drawstring holder when the trigger assembly is activated.

38. The crossbow in claim 32, wherein the power cables and drawstring wind around the cams at least one complete rotation.

* * * * *